US012778232B2

(12) United States Patent
Mazzarolo et al.

(10) Patent No.: US 12,778,232 B2
(45) Date of Patent: Nov. 3, 2026

(54) PROTECTIVE HELMET

(71) Applicant: ALPINESTARS RESEARCH S.P.A., Maser (IT)

(72) Inventors: Giovanni Mazzarolo, Coste di Maser (IT); Roberto Parissenti, Sedico (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 144 days.

(21) Appl. No.: 18/579,419

(22) PCT Filed: Jul. 15, 2022

(86) PCT No.: PCT/IB2022/056521
§ 371 (c)(1),
(2) Date: Jan. 15, 2024

(87) PCT Pub. No.: WO2023/286018
PCT Pub. Date: Jan. 19, 2023

(65) Prior Publication Data

US 2024/0315377 A1 Sep. 26, 2024

(30) Foreign Application Priority Data

Jul. 16, 2021 (IT) ..... 102021000018902

(51) Int. Cl.
*A42B 3/12* (2006.01)
*A42B 3/32* (2006.01)

(52) U.S. Cl.
CPC ..... *A42B 3/127* (2013.01); *A42B 3/328* (2013.01)

(58) Field of Classification Search
USPC ..... 2/414
See application file for complete search history.

(56) References Cited

U.S. PATENT DOCUMENTS 3,447,162 A * 6/1969 Aileo ..... A42B 3/145 2/209
3,693,494 A * 9/1972 Meyer ..... F16B 21/086 411/508

(Continued)

FOREIGN PATENT DOCUMENTS

| | | |
|---|---|---|
| EP | 2022358 B1 | 4/2012 |
| EP | 3432746 B1 | 11/2019 |
| WO | 2019162073 A1 | 8/2019 |

OTHER PUBLICATIONS

International Search Report and Written Opinion of the International Application No. PCT/IB2022/056521, mailed Oct. 19, 2022, 7 pg.

*Primary Examiner* — Matthew R Marchewka
(74) *Attorney, Agent, or Firm* — Fredrikson & Byron, P.A.

(57) ABSTRACT

The present invention relates to a protective helmet (1) comprising: an outer shell (10); an impact absorbing liner (12), positioned inside the outer shell (10), and a comfort liner (14), positioned at an inner surface of the impact absorbing liner (12), so as to be in contact with the user's head during the use of the protective helmet (1). The comfort liner (14) comprises at least one cheek pad (16) which is coupled to the impact absorbing liner (12) by means of at least one connecting element (22). Said at least one connecting element (22) is elastically deformable for moving between a first configuration, wherein it is adapted to be either inserted or released from a corresponding recess (24) provided in the impact absorbing liner (12), and a second configuration, wherein it is adapted to be clamped inside said recess (24). According to the invention, the protective helmet (1) comprises a release device (30) connected to said at least one connecting element (22). Said release device (30) when actuated is able to elastically deform said at least (Continued)

one connecting element (22) to move said at least one connecting element (22) from its second configuration into the first configuration, thereby allowing the release of said at least one cheek pad (16) from the impact absorbing liner (12).

22 Claims, 9 Drawing Sheets

(56) References Cited

U.S. PATENT DOCUMENTS 4,916,759 A * 4/1990 Arai ..... A42B 3/127 2/424
6,170,084 B1 * 1/2001 Gordon ..... A42B 3/28 2/12
6,185,753 B1 * 2/2001 Arai ..... A42B 3/281 2/424
6,256,797 B1 * 7/2001 Nemoto ..... A42B 3/328 2/424
6,353,978 B1 * 3/2002 Kawahara ..... A44B 17/0035 24/114.4
6,421,841 B2 * 7/2002 Ikeda ..... A42B 3/127 2/414
8,239,970 B2 * 8/2012 Ikeda ..... A42B 3/127 24/114.4
9,681,697 B2 * 6/2017 Ikeda ..... A42B 3/142
2007/0271688 A1 * 11/2007 Ando ..... A42B 3/127 2/410
2009/0038054 A1 2/2009 Ikeda
2011/0099776 A1 * 5/2011 Anscher ..... A44B 11/266 24/701
2012/0174294 A1 7/2012 Sackett
2018/0035742 A1 2/2018 Salvetti et al.
2018/0310729 A1 * 11/2018 Tear ..... A47F 5/0006
2020/0138142 A1 * 5/2020 Kim ..... A42B 3/328
2020/0163401 A1 * 5/2020 Lee ..... A42B 3/328
2021/0106091 A1 * 4/2021 Glover ..... A63B 71/08

* cited by examiner

PROTECTIVE HELMET

RELATED APPLICATIONS

This application is a 35 U.S.C. 371 national stage filing from International Application No. PCT/IB2022/056521, filed Jul. 15, 2022, which claims priority to Italian Patent Application No. 102021000018902, filed Jul. 16, 2021. The entire contents of each of these applications is incorporated herein by reference in their entirety.

FIELD OF THE INVENTION

The present invention relates to a protective helmet. More specifically, the present invention relates to a protective helmet for sport activities, like for example motorcycle, motocross, car racing, cycling and skiing.

BACKGROUND

As it is well known in the art, the protective helmets, which are used during sporting activities, are generally based on three primary components: an outer shell, an impact absorbing liner and a comfort liner.

The outer shell, made of a rigid material, for example a thermoplastic polymer, like polycarbonate or a fiber-reinforced polymer, has the function to protect the head of the helmet's user against impacts.

The outer shell is also suitable for dissipating, at least partially, in case of an accident, the impact forces acting on the helmet by transferring them to the second component of the helmet, the impact absorbing liner.

The impact absorbing liner is positioned inside and adjacent to the outer shell and it is dome shaped so as to correspond to the shape of the user's head.

The function of the impact absorbing liner is to absorb the impact forces which are generated during an accident, thereby preserving the user's head.

Generally, the impact absorbing liner is made of relatively rigid material, like for example expanded polystyrene.

The third component is the comfort liner which is positioned on the surface of the impact absorbing liner facing the user's head.

The comfort liner is usually made of a combination of soft foam and fabric materials and has the function to make the helmet comfortable, by avoiding that the user's head gets in direct contact with the relatively rigid impact absorbing liner.

Usually, the comfort liner comprises interior pads which are removably coupled by means of releasable fastening means to the impact absorbing liner.

These interior pads are removable from the impact absorbing liner both for maintenance reasons, for allowing the pads to be cleaned or washed and replaced after a certain period of use, and for safety reasons, for allowing the removal of the helmet without applying any traction force on the neck of the user in case of an accident.

In particular, by removing the cheek pads designed to come into contact with the side parts of the face of the user, the removal of the helmet from the user's head is simplified.

However, the removal of the cheek pads when the helmet is worn by the user is not easy in case of emergency situations, since generally the cheek pads are fastened to the helmet by means of plastic or metal snaps which need to assure a firm connection between the helmet and the cheek pads, to avoid that during wearing of the helmet the cheek pads might be detached so as to bother the user.

An example of fastening means between the cheek pads and the helmet is provided in EP2022358B1.

In particular, EP2022358B1 discloses a recess-projection engaging mechanism designed to attach a cheek pad to an impact absorbing liner. Such a mechanism preferably includes an engaging pin on the back portion of the cheek pad and a notched engaging hole on the impact absorbing liner.

When the cheek pad is pulled outward from inside the helmet by means of a pull member, the engaging pin moves outside of the engaging hole through a notch of the engaging hole.

Such a solution, even if appreciated, has some drawbacks.

First of all, in order to allow the removal of the cheek pad, the user needs to elastically deform the frame on which the engaging pins are applied.

As a matter of fact, without such a deformation, the frame cannot properly rotate around the engaging pins.

Moreover, in order to prevent the accidental release of the engaging pin from the notched engaging hole, an inclined plane is provided at the bottom portion of the engaging hole.

Consequently, to release the engaging pin from its notched engaging hole, it is necessary to move the engaging pin not only in a downward direction, but also towards the inner portion of the helmet along such an inclined plane.

When the helmet is worn by the user, this movement is hindered by the user's head.

Moreover, in case of an accident if the user has undergone some injuries, there is the risk that such an operation might result in a movement of the head of the injured user, also in view of the fact that the helmet usually fits snugly on the head of the user.

A further example of cheek pads fastened to the inner side of a helmet by mechanical fastening means is disclosed in WO2019162073A1.

In particular, WO2019162073A1 discloses a helmet provided with a removal unit, comprising first and second fastening elements, by means of which a cushioning pad is connected to the impact absorbing liner.

The first fastening element consists of a pin, while the second fastening element consists of a receptacle seat connected to a transversal slot running from the receptacle seat towards the lower rim of the helmet.

The cushioning pad can be released from the impact absorbing liner by acting on the removal unit by means of a tension element along a release direction oriented perpendicularly to a medial plug-in connection direction.

In particular, the release force exerted by the tension element needs to be oriented along the transversal slot.

Also this system has some drawbacks.

The first one is that, as anticipated, the cheek pad can be released from the helmet only in case the release force is oriented along the transversal slot.

However, it is difficult for the user to direct the release force exactly along the transversal slot because, when the cheek pads are applied to the helmet, the transversal slot is not visible. Consequently, it is not easy to remove the cheek pads from the helmet.

Obviously, such difficulties are even higher if the cheek pads need to be removed when the helmet is worn by an injured rider.

Moreover, when the cheek pad has to be released in emergency situations, a not negligible traction force needs to be applied on the tension element to overcome the friction between the engaging pin and the transversal slot and to allow the pin to be detached from its seat. Therefore, the risk exists that such a traction force might at least in part be transferred to the neck of the user, with the possible consequent problems from the safety point of view.

BRIEF SUMMARIES OF OBJECTS OF THE INVENTION

The main object of the present invention is therefore to provide a protective helmet designed to overcome or at least reduce the drawbacks mentioned above with reference to the known protective helmets.

More specifically, the main object of the present invention is to provide a protective helmet having cheek pads which are connectable to the helmet by means of a simplified device.

Another object of the present invention is to provide a protective helmet having cheek pads suitable for being readily and easily removed from the helmet, in particular in case of emergency.

A further object of the present invention is to provide a protective helmet having cheek pads which, in case of emergency, require a reduced traction force for being released from the helmet.

Finally, an object of the present invention is to provide a protective helmet having cheek pads which can be released by means of a release force oriented along different directions.

The above mentioned objects, and other objects that will better appear from the following description, are achieved by a protective helmet according to claim 1.

BRIEF DESCRIPTIONS OF THE DRAWINGS

The advantages and the characteristic features of the invention will appear more clearly from the following description of preferred, but not exclusive, embodiments of the protective helmet, illustrated in the accompanying figures in which.

Figure 14A:
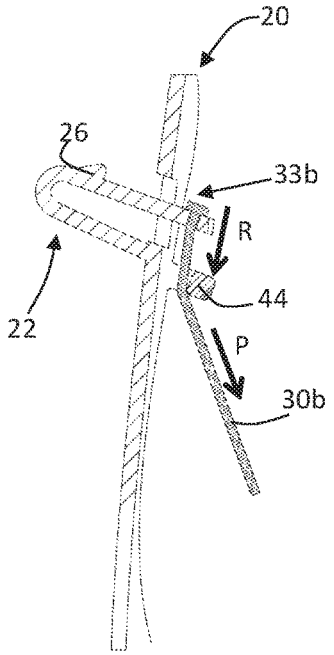
Figure 14B:
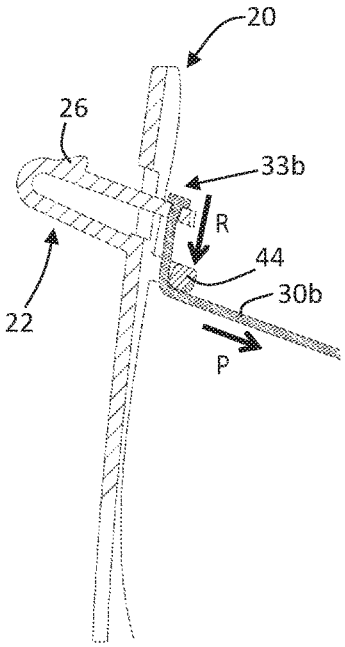
Figure 14C:
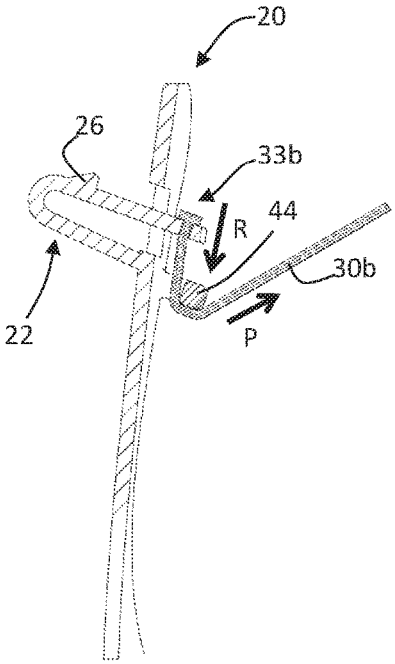
Figure 15:
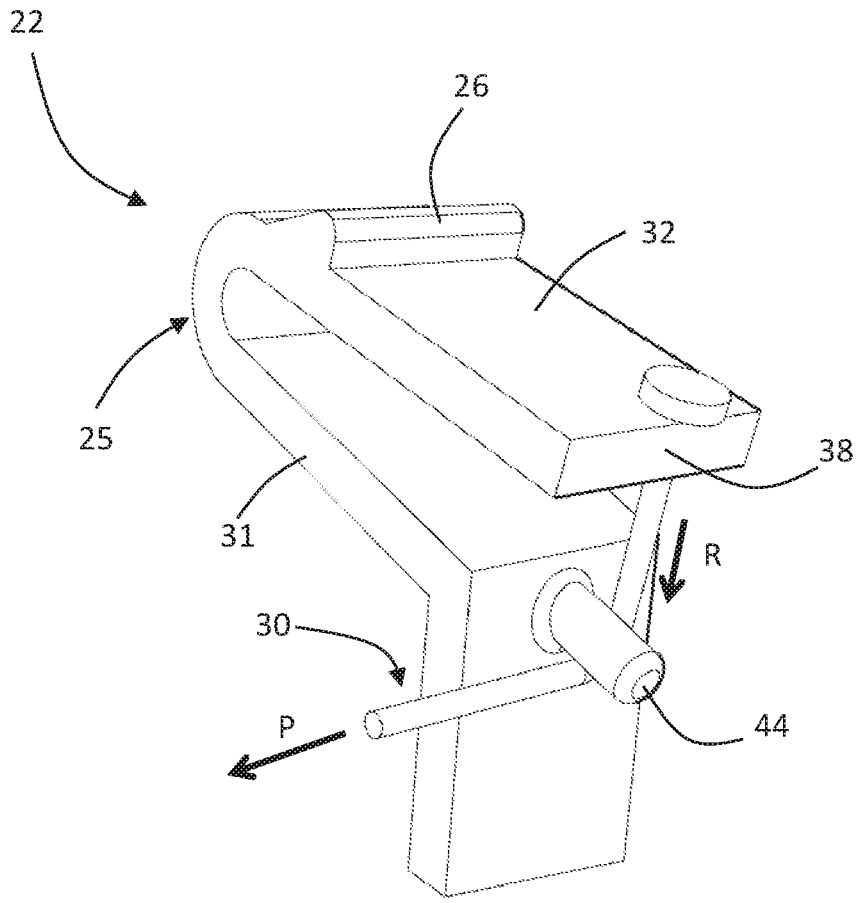

FIGS. 14*a*, 14*b* and 14*c* schematically show how the pulling force can be directed in order to detach the cheek pad from the impact absorbing liner;

FIG. 15 schematically shows how the release force and the pulling force can be directed during the release of the cheek pad from the impact absorbing liner.

DETAILED DESCRIPTION OF EMBODIMENTS OF THE INVENTION

In the following description of a protective helmet according to the invention, as "elastically deformable element" there will be indicated an element which is able to change its shape as a reaction to an applied force. This change of the shape is only temporary and once the force is released, the undeformed shape of the element is restored.

Moreover, as "top" there will be indicated the part or component of the helmet which, during the normal use, is relatively farther from the ground and as "lower" the part or component relatively closer.

Moreover, as "inner" there will be indicated the part or component of the helmet which, during the normal use, is relatively closer to the user's head and as "outer" the part or component relatively farther.

With reference to the attached figures, an example of a protective helmet according to the invention is indicated as a whole by the reference 1. Said protective helmet 1 is suitable for being used in particular by motorcyclists. Nevertheless, as it will appear more clearly from the following description, the protective helmet 1 can also be advantageously used by cyclists, skiers or in other fields where an effective protection of the user's head must be obtained.

Figure 1:
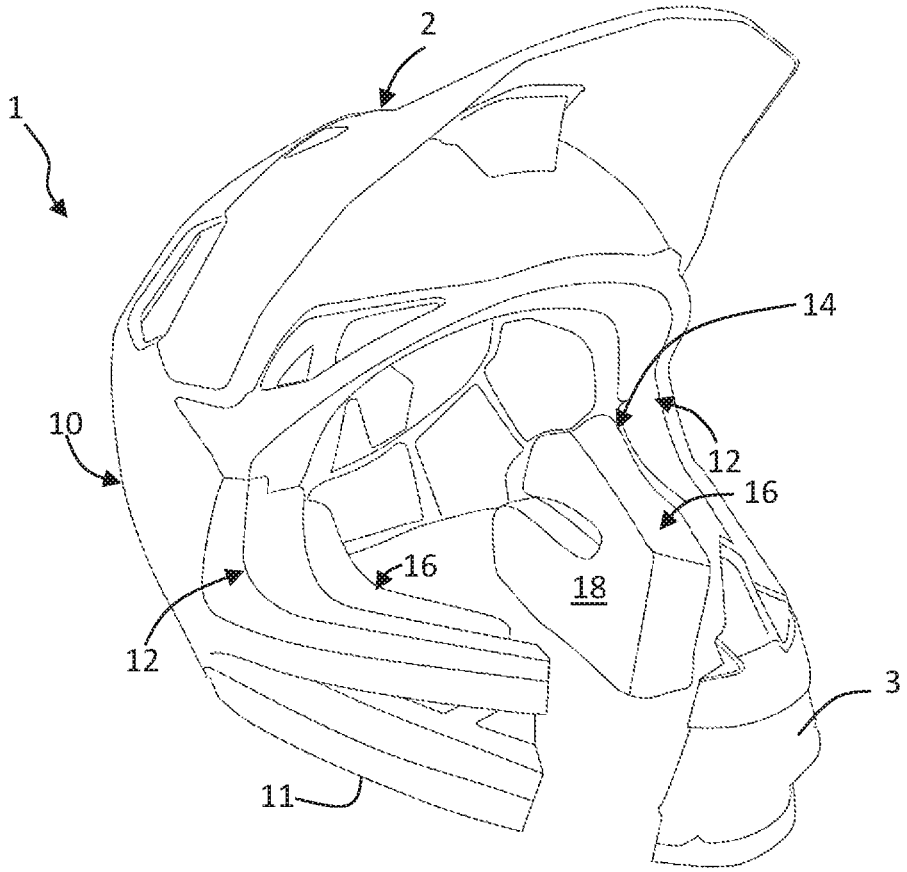
FIG. 1 shows, in schematic form, a perspective view of a protective helmet (with portions broken away) according to the present invention.

As shown in FIG. 1, the protective helmet 1 comprises an outer shell 10, which is preferably made of rigid material, for example thermoplastic polymer, like polycarbonate or a fiber-reinforced polymer. The outer shell 10 is preferably dome shaped so as to fit over the user's head.

The protective helmet 1 can comprise a visor 2 which is designed to be removably coupled to the outer shell 10 so as to project over a front opening of the outer shell 10.

The protective helmet 1 shown in FIG. 1 is also provided with a chin guard 3. However, the teachings of the present invention can also be advantageously applied to helmets which are not provided with a chin guard, namely the so-called "jet helmets".

As shown in FIG. 1, the protective helmet 1 also comprises an impact absorbing liner 12 which is positioned inside the outer shell 10. In detail, the impact absorbing liner 12 is designed to internally line the outer shell 10 for absorbing the energy of impact and offering an additional protection to the user's head.

Preferably, the impact absorbing liner 12 is made of an expanded polymeric material, for example expanded polystyrene, polypropylene or polyurethane.

Moreover, the protective helmet 1 comprises a comfort liner 14 positioned at an inner surface of the impact absorbing liner 12, so as to be in contact with the user's head during the use of the protective helmet 1. The comfort liner 14 can be made with synthetic foam, for example it can be a polyurethane foam pad, covered with a skin-friendly fabric.

The comfort liner 14 comprises at least one cheek pad 16. Preferably, the protective helmet 1 comprises two cheek pads 16 designed to be positioned on either inner side of the protective helmet 1.

The comfort liner 14 can comprise a further pad, the so-called "neck roll pad", which is in the form of a cylindrical foam piece that extends around the rear lower part of the helmet. Such a pad, which is not shown in the enclosed figures, is either an integral part of the comfort liner 14 or a separate component permanently secured to the comfort liner.

Figure 2:
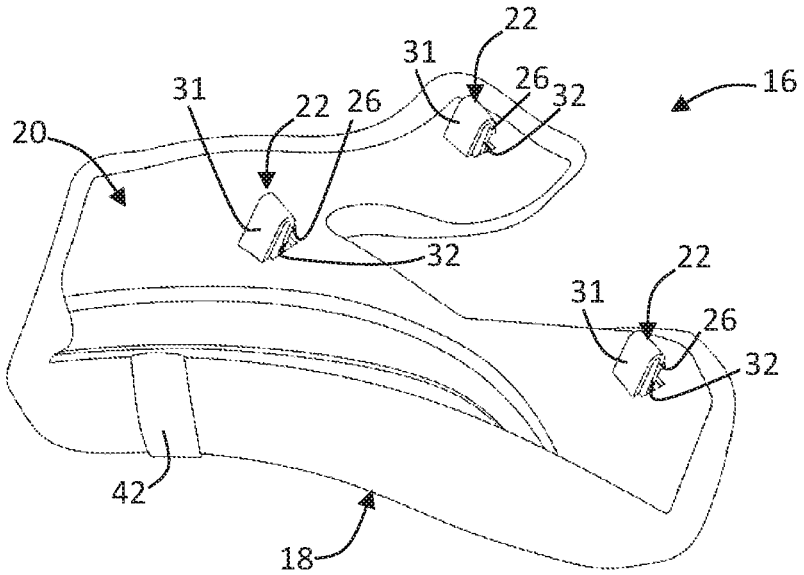
FIG. 2 shows a perspective rear view of a cheek pad of the protective helmet according to one embodiment of the present invention.

Each cheek pad 16 may include a padding layer 18 and a pad back plate 20 (see FIG. 2).

The pad back plate 20 is preferably made of a polymeric material. More preferably, the pad back plate 20 is made from a rigid polymeric material. The pad back plate 20 can be fastened to the padding layer 18 by means of mechanical fastening means, for example by means of stitching, or by means of adhesive material.

Each cheek pad 16 is coupled to the impact absorbing liner 12 by means of at least one connecting element 22. Preferably said connecting element 22 projects from the pad back plate 20 in a direction opposite to the padding layer 18.

Figure 3:
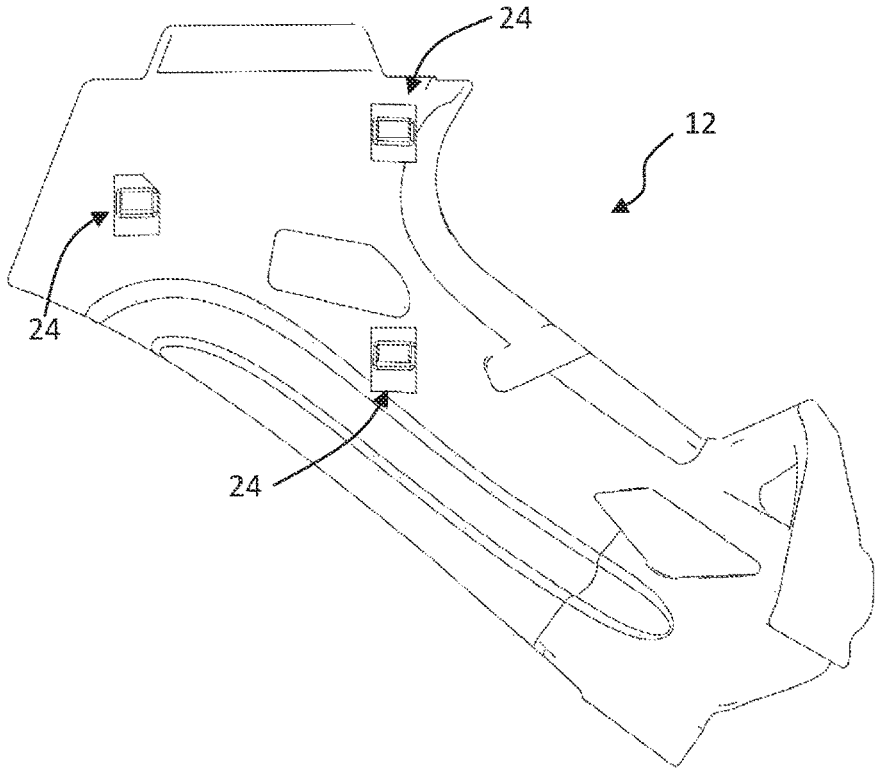
FIG. 3 shows a detailed view of a portion of the impact absorbing liner of the helmet, wherein receiving connectors are visible.

Said connecting element 22 is elastically deformable for moving between a first configuration, wherein it may be either inserted or released from a corresponding recess 24 provided in the impact absorbing liner 12 (see FIG. 3), and a second configuration, wherein it may be clamped inside said recess 24.

According to the invention, the protective helmet 1 comprises a release device 30 which is connected to the connecting element 22. In particular, the release device 30, when it is actuated, is able to elastically deform the connecting element 22 to move this element from its second configuration into its first configuration, thereby allowing the release of the cheek pad 16 from the impact absorbing liner 12 (see FIGS. 9-12).

As it will clearly appear from the following description, the firm clamping of the connecting element 22 inside the corresponding recess 24, when the connecting element 22 is in its second configuration, guarantees a secure connection of the cheek pads 16 to the impact absorbing liner 12 during the normal use of the protective helmet.

At the same time, the combination of the release device 30 with the elastically deformable connecting element 22 permits to easily move the connecting element 22 in its first configuration every time is needed, so as to allow the removal of the cheek pads 16 from the protective helmet 1.

In particular, during an emergency situation, the provision of the release device 30 in combination with the elastically deformable connecting element 22 allows to remove the cheek pads 16 from the inside of the protective helmet 1 without stressing the neck of the injured user.

Moreover, as it will be described in detail in the following, contrarily to the known solutions, the release device 30 can be actuated by exerting on it a pulling force which can be oriented along different directions, without any limitation.

Advantageously, the connecting element 22 is integral with the pad back plate 20. Alternatively, the connecting element 22 can be fastened to the pad back plate 20 by means of fixing means.

Preferably, each cheek pad 16 is provided with three connecting elements 22 spaced from each other over the pad back plate 20 (see for example FIG. 2). Advantageously, the connecting elements 22 are arranged in proximity of the external perimeter of the pad back plate 20.

However, the number and the position of the connecting elements 22 can be varied according to specific needs.

Preferably, as it is shown in the enclosed FIGS. 5-12, the connecting element 22 is a snap-fit device designed to be clamped inside a corresponding mating recess 24 provided in the impact absorbing liner 12.

Figure 8:
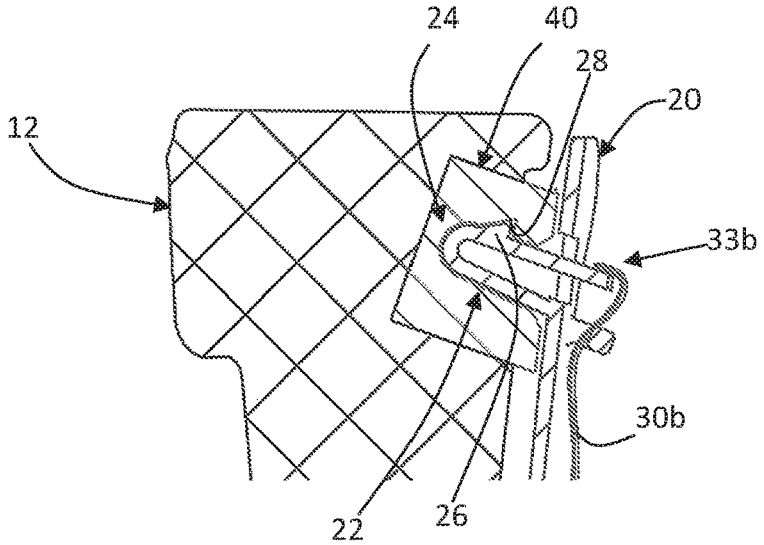
FIG. 8 shows an enlarged view of the detail identified by the letter A in FIG. 7.
Figure 8A:
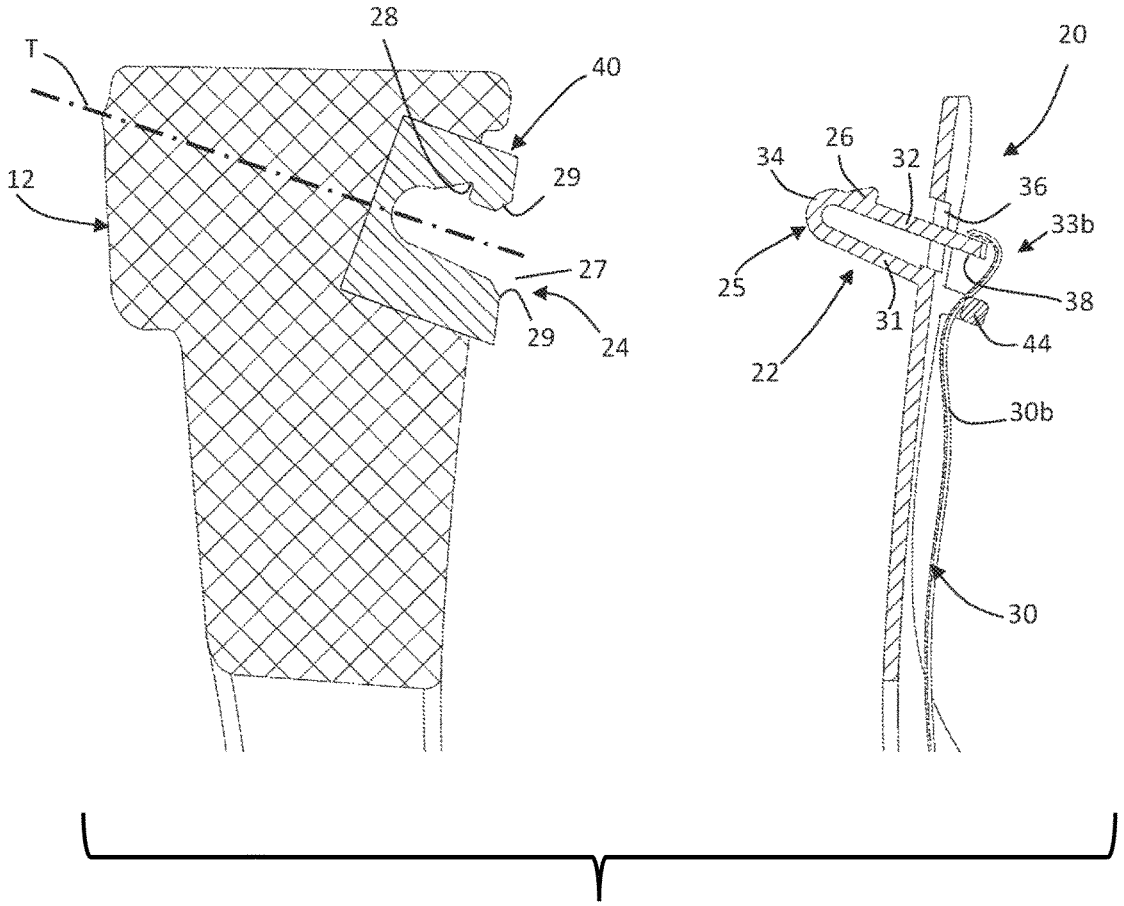
FIG. 8A is an exploded view of FIG. 8.

Advantageously, the connecting element 22 comprises a main body 25 having an outwardly projecting portion 26, for example a hook or stud, which is designed to enter and be caught in a corresponding depression 28 provided in the mating recess 24 (see for example FIG. 8A).

Preferably, the outwardly projecting portion 26 is tapered towards its forward end, namely the distal end from the pad back plate 20.

During the coupling of the cheek pad 16 to the impact absorbing liner 12, the main body 25 of the connecting element 22 makes contact and slides along the inner surface of the recess 24.

Such a sliding, in combination with the tapered shape of the projecting portion 26, causes the temporary inward bending of the projecting portion 26.

Once the insertion of the connecting element 22 inside the recess 24 is completed, the projecting portion 26 is able to return to a substantially stress-free condition and thus to its initial configuration, by being caught inside the corresponding depression 28 (see for example FIG. 8).

In this way, the connecting element 22 is securely clamped inside the recess 24 and thus the cheek pad 16 is firmly connected to the impact absorbing liner 12.

The release device 30 is preferably connected to the connecting element 22 in proximity of the projecting portion 26. By acting on the release device 30 it is possible to inwardly bend the projecting portion 26 so as to permit the disengagement of the projecting portion 26 from the depression 28 and the release of the connecting element 22 from the recess 24.

Advantageously, the connecting element 22 can be a cantilever snap-fit device. More preferably, the connecting element 22 can be a U-shaped cantilever snap-fit device.

In this embodiment, the main body 25 of the connecting element 22 comprises a first arm 31 and a second arm 32 connected to each other at a base portion 34. The projecting portion 26 is preferably provided on the second arm 32.

The first arm 31 is rigidly connected to the base plate 20 of the cheek pad 16 and extends from the base plate 20 towards the base portion 34 of the snap device 22.

The second arm 32, in turn, extends from the base portion 34 of the snap device 22 towards a groove 36 provided in the base plate 20 so that an end 38 of the second arm 32 is free to oscillate, when stressed, inside said groove 36.

Preferably the projecting portion 26 is provided on the second arm 32 in proximity of the base portion 34 of the connecting element 22, while the release device 30 is connected to the connecting element 22 in proximity of the end 38 of the second arm 32 (see FIG. 8A).

As shown in the enclosed figure, the U-shaped cantilever snap-fit device 22 is designed to be inserted inside the corresponding recess 24 with the second arm 32 positioned above the first arm 31 with respect to a horizontal plane.

Figure 9:
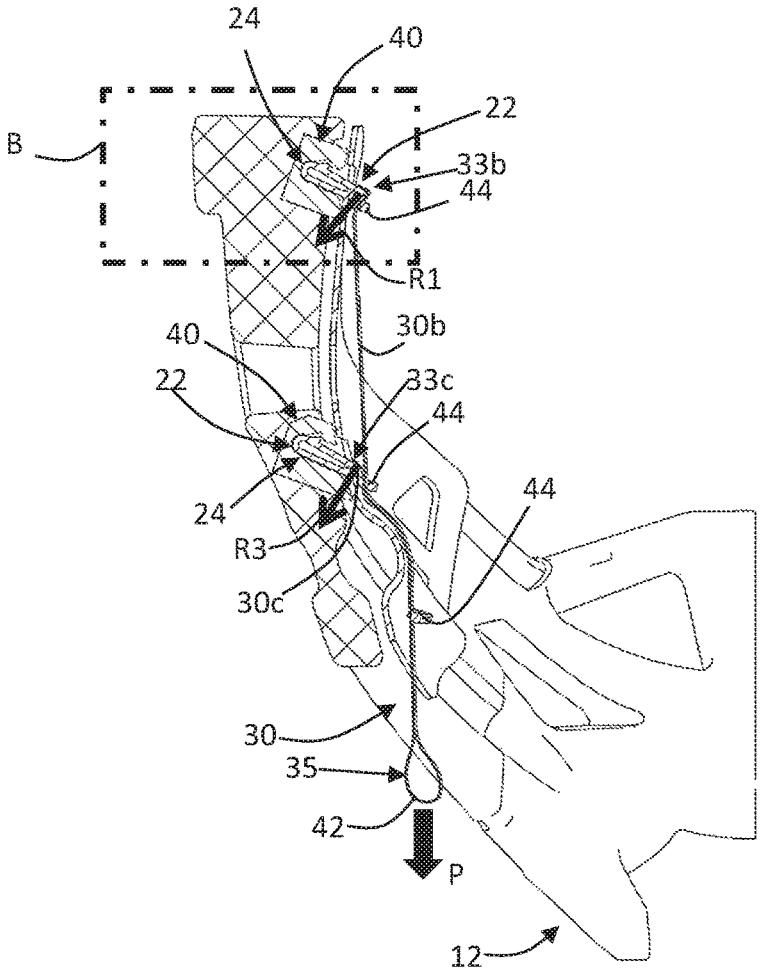
FIG. 9 is a view similar to FIG. 7, but showing the connecting means between the cheek pads and the impact absorbing liner in a different configuration.
Figure 10:
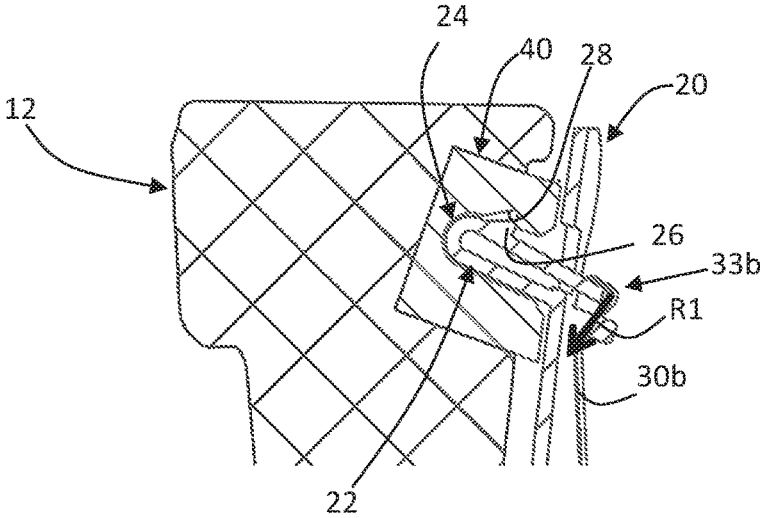
FIG. 10 shows an enlarged view of the detail identified by the letter B in FIG. 9.
Figure 11:
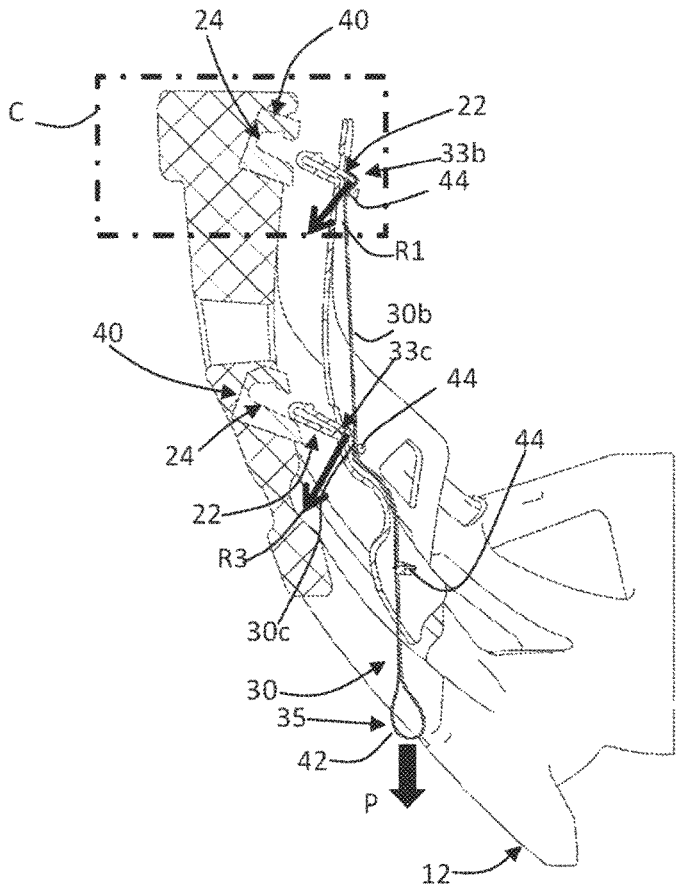
FIG. 11 is a view similar to FIGS. 7 and 9, but showing the connecting means between the cheek pads and the impact absorbing liner in a further configuration.
Figure 12:
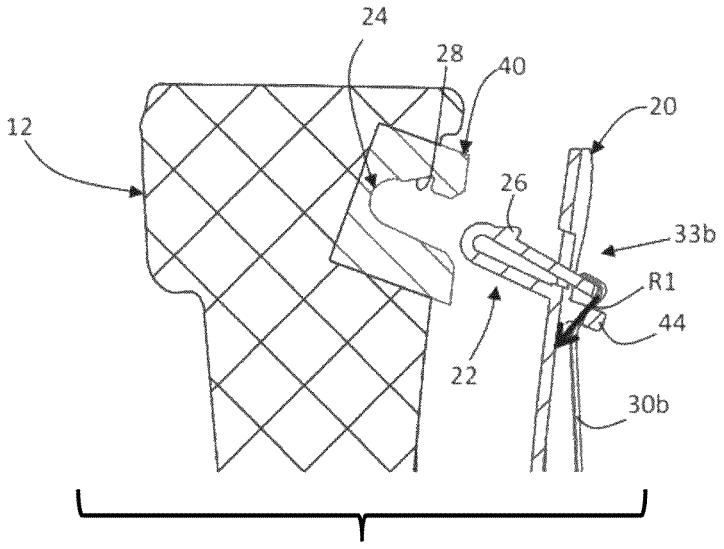
FIG. 12 shows an enlarged view of the detail identified by the letter C in FIG. 11.

Consequently, when the release device 30 is actuated by the user, the second arm 32 tends to bend towards the first arm 31 (see FIGS. 9-10).

In this way, the base portion 34 acts as a fulcrum of a lever wherein the flexural rigidity of the connecting element 22 is the resistance and the force acting on the end 38 of the second arm 32 of the connecting element 22 is the load.

The recess 24 in turn substantially consists in a blind hole extending from the inner surface of the impact absorbing liner 12 towards the outer shell.

Preferably, the depth of the recess 24 corresponds to the projecting height of the connecting element 22. "Projecting height" of the connecting element 22 means the radial distance between the radially outermost portion of the connecting element 22 and the portion of the connecting element close to the pad back plate 20.

Figure 7:
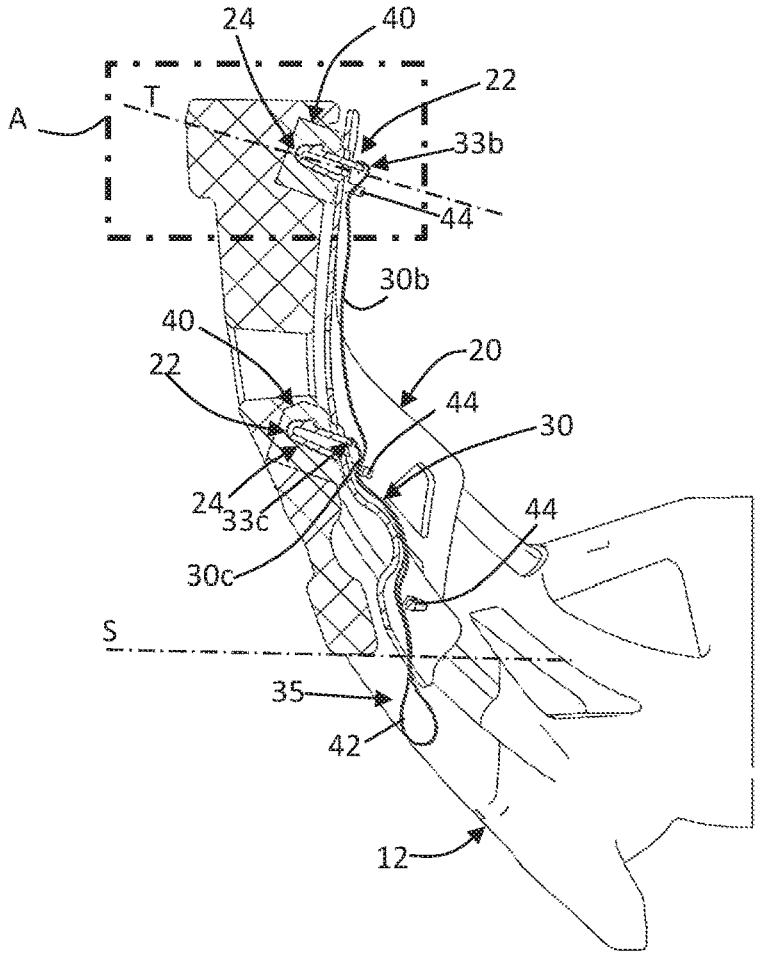
FIG. 7 is a schematic cross section taken along the line VII-VII of FIG. 4.

Advantageously, the recess 24 lies on a plane T which is inclined with respect to a plane S passing through the lower edge 11 of the helmet 1 (see FIG. 7).

In this way, the release of the cheek pad 16 from the impact absorbing liner 12 is easier.

Advantageously, the recess 24 has an entering opening 27 which is delimited by chamfered edges 29, so as to facilitate the insertion of the connecting element 22 into the recess 24.

Preferably, the recess 24 is provided inside a retaining element 40 rigidly fastened to the impact absorbing liner 12. The retaining element 40 can be fastened to the impact absorbing liner 12 by glue or during the in-moulding process of the impact absorbing liner.

The release device 30 preferably comprises a strap or a cord having a first end 33 connected to the connecting element 22 and a second end 35 designed to be positioned at the lower portion of the cheek pad 16. In this way, when the protective helmet 10 is in use, the second end 35 can be positioned outside the lower edge 11 of the protective helmet 10 (see FIG. 4).

Figure 6:
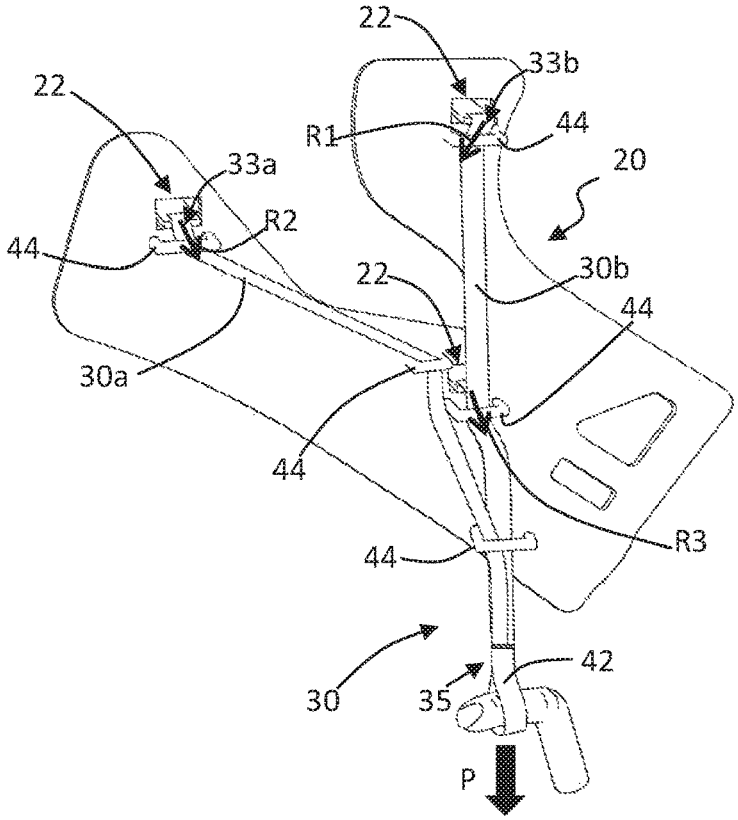

Preferably, the second end 35 of the release device 30 is provided with an actuating element 42, like a tab or a hook, which can be easily reached by the user for allowing the detachment of the cheek pad 16 from the impact absorbing liner 12 (see for example FIG. 6).

In case the cheek pad 16 is provided with more than one connecting element 22, the release device 30 comprises more than one strap or cord 30*a*, 30*b*, 30*c* in the number of the connecting elements 22.

Figure 4:
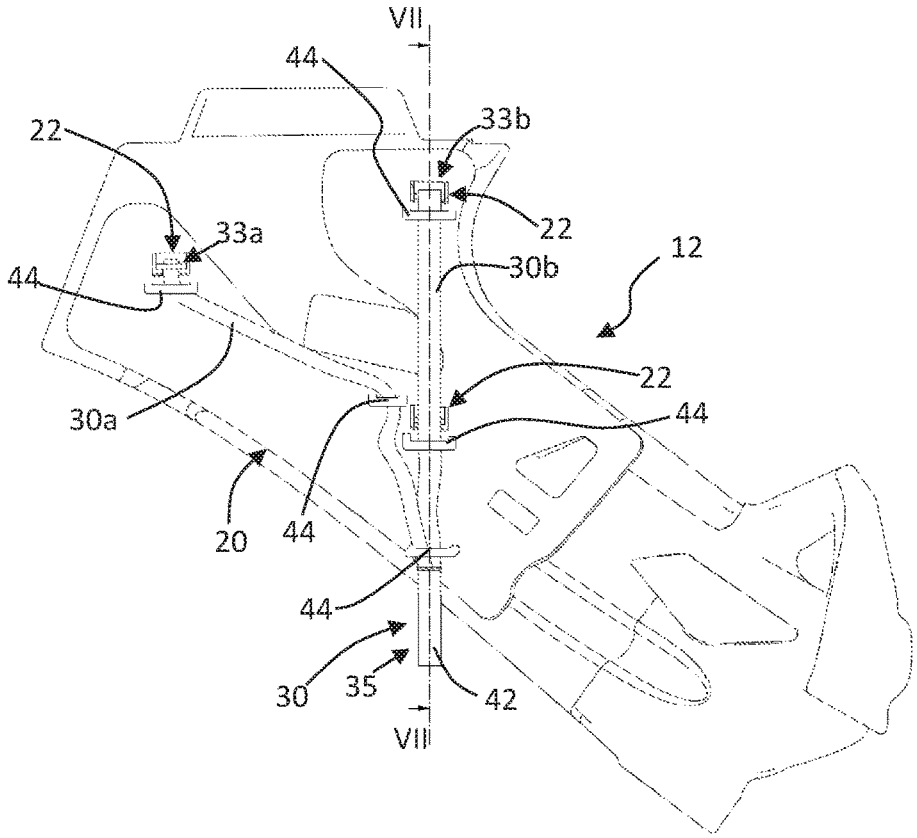
FIG. 4 shows a view similar to FIG. 3, wherein the back plate of the cheek pad is fastened to the impact absorbing liner of the helmet.
Figure 5:
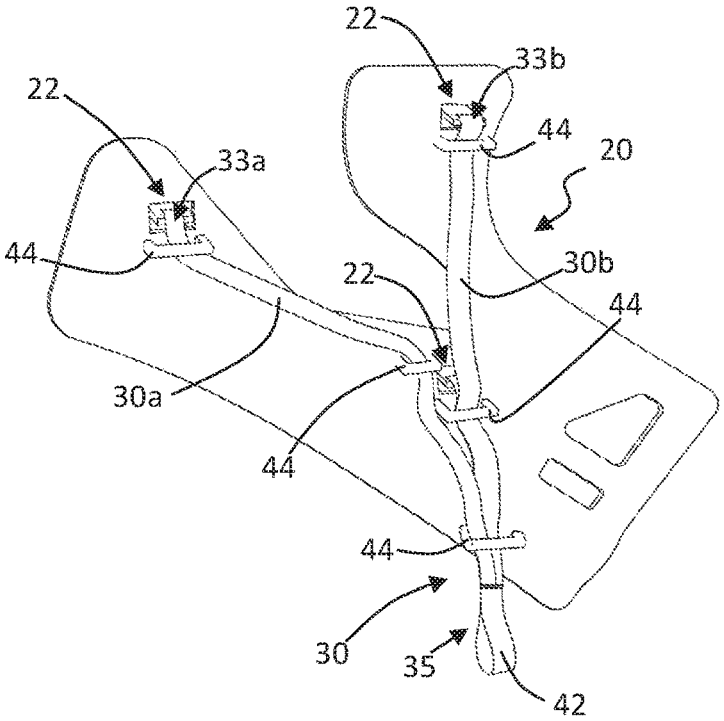
FIGS. 5 and 6 show the back plate of the cheek pad with the operating strap.

Said straps or cords have their respective first ends 33*a*, 33*b*, 33*c* connected to a different connecting element 22 and their second ends connected to each other so as to be combined in a single strap 30 provided with a single actuating element 42 (see for example FIGS. 4 and 7).

As shown in the enclosed figures, the release device 30 is preferably positioned between the pad back plate 20 and the padding layer 18.

Advantageously, the release device 30 is positioned inside empty spaces arranged between the pad back plate 20 and the padding layer 18 so as to avoid that a portion of the release device 30 might get blocked between the two components of the cheek pads.

Preferably, as shown for example in FIG. 4, the pad back plate 20 comprises on its inner surface guiding means 44 suitable for engaging the release device 30.

The guiding means 44 have the function to guide the portion of the release device 30 comprised between the first end 33*a*, 33*b*, 33*c*, connected to the connecting element 22, and the second end 35, provided at the lower edge of the cheek pad 16.

As shown in FIG. 6, the provision of the guiding means 44 permits to actuate by means of a single tab 42 the various straps connected to the connecting elements 22, assuring that the pulling force P applied to the tab 42 may be properly transmitted to each connecting element 22, so as to allow the release of the latter from the corresponding recess 24.

With reference to the embodiment shown in the figures, the guiding means 44 direct the pulling force P applied to the tab 42 of the release device 30 to the connecting element 22 along a direction indicated by the arrows R1, R2, R3 which causes the bending, namely an elastic deformation, of the connecting element 22. Such bending in turn causes the disengagement of the corresponding projecting portion 26 from the depression 28.

In case the connecting element is a U-shaped cantilever snap-fit device 22 the pulling force P applied to the tab 42 by means of the guiding means 44 is transferred to the connecting element 22 along a release direction R1, R2, R3 which causes the bending of the second arm 32 towards the first arm 31 of the connecting element 22, so as to allow the release of the projecting portion 26 from the depression 28.

In this way, as it is schematically shown in FIGS. 14*a*, 14*b*, 14*c* and 15, the provision of the guiding means 44 advantageously permits not to have limitation in terms of direction of the pulling force P.

As a matter of fact, by means of the guiding means 44 the pulling force P applied to the tab 42, even if directed along different directions (see FIGS. 14*a*, 14*b* and 14*c*), can be always transmitted along the release direction R which allows the release of the connecting element 22 from the recess. In other words, the direction of the pulling force P is separated from the direction of the release force R.

Moreover, by means of the guiding means 44 (see FIG. 15), the pulling force P can also be directed along a different plane with respect to the plane on which the release forces R lies.

Consequently, the release of the cheek pads, in particular during emergency situations, is extremely simplified.

As shown in the enclosed figures, the guiding means 44 can consist of arch elements designed to be engaged by the release device 30. Alternatively, the guiding means 44 can comprise guiding pins.

Figure 13:
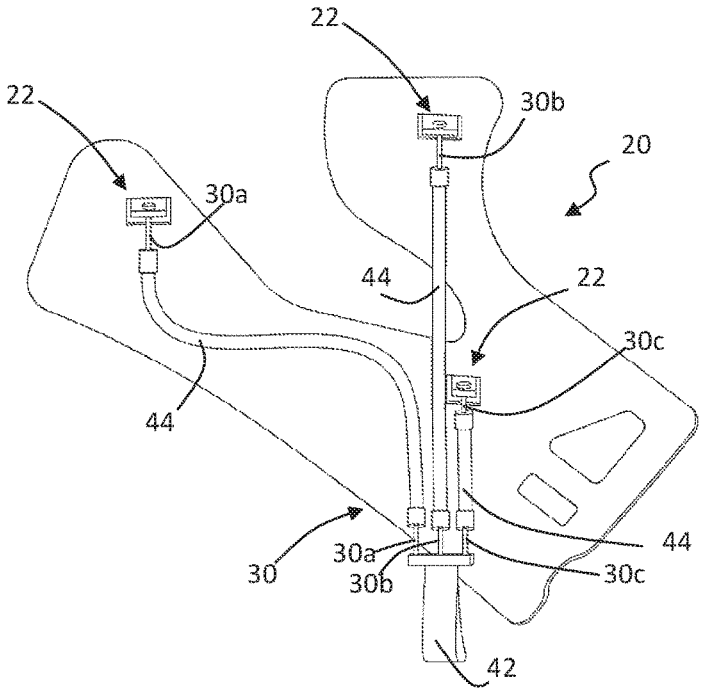
FIG. 13 shows a figure similar to FIG. 5, but relating to a different embodiment.

In a further embodiment (see FIG. 13) the guiding means 44 can consist in one or more Bowden cables designed to house the release device 30.

In case the release device 30 comprises more than one strap or cord 30*a*, 30*b*, 30*c*, each strap or cord will be housed in a separate Bowden cable.

The Bowden cables are preferably fastened to the pad back plate 20.

Hereafter the operation of the release device 30 to permit the release of the cheek pads 16 from the impact absorbing liner 12 will be described by making reference to the embodiment wherein the connecting elements 22 are in the form of a U-shaped cantilever snap-fit device.

The following notes are nevertheless also valid for the other embodiments before disclosed.

In order to fasten the cheek pads 16 inside the protective helmet 1, the user needs to place the cheek pad 16 with the connecting elements 22 facing the corresponding recesses 24. The connecting elements 22 are in a stress-free configuration which substantially coincides with their second configuration.

Afterwards, by means of a slightly pushing force, the connecting elements 22 can be inserted inside the mating recesses 24 through the openings 27 of the recesses 24. Such an insertion causes an elastic deformation of the connecting elements 22 which assume their first configuration.

In particular, such an insertion causes the bending of the second arm 32 towards the first arm 31 of the connecting element 22 so that the projection portion 26 can be inserted inside the recess 24.

Once the insertion is completed, namely when the connecting elements 22 are fully housed inside their mating recesses 24, the connecting elements 22 are able to restore their initial shape, so that the projecting portions 26 are able to engage the depressions 28, assuring the clamping of the connecting elements 22 inside the recesses 24.

To remove the cheek pads from the helmet, the user has to pull the tab 42 of the release device 30 towards the lower portion of the cheek pad 16, without being forced to direct such a pulling force P along a specific direction.

As a matter of fact, the pulling force P applied to the tab 42 is anyway transmitted (see FIGS. 14*a*, 14*b*, 14*c* and 15) to the connecting elements 22 so as to generate the release forces R1, R2, R3 which cause the bending of the second arms 32 of the connecting elements 22.

The connecting elements 22 move thus in their first configuration, wherein the projecting portions 26, after the bending of the second arms 32, are no longer engaged in the corresponding depressions 28, so as to permit the release of the connecting elements 22 from the recesses 24 (see FIGS. 9-12).

By maintaining a pull force P on the tab 42, such a force which is directed towards the bottom edge of the helmet, will cause the downward movement of the cheek pad which can thus be removed from the helmet.

It is clear now how the present invention allows to achieve the predefined objects.

The mutual arrangement of the connecting elements 22 and the release device 30 allows an easy removal of the cheek pads from the helmet not only during the normal use of the helmet, but also in case of emergency.

Moreover, the connection between the connecting elements and the release device permits to remove the cheek pad from the helmet by applying on the release device a reduced pulling force. As a matter of fact, the connection of the release device to the connecting elements realizes a lever.

Furthermore, the mutual arrangement between connecting elements, release device and guiding means permits to release the cheek pads from the helmet by applying a pulling force which can be oriented along different directions, without any limitation.

Finally, the release device has a simplified structure and it can be easily operated by the user.

With regard to the embodiments of the protective helmet described above, the person skilled in the art may, in order to satisfy specific requirements, make modifications to and/or replace elements described with equivalent elements, without thereby departing from the scope of the accompanying claims.

The invention claimed is:

1. A protective helmet comprising:

an outer shell;

an impact absorbing liner, positioned inside the outer shell;

a comfort liner positioned at an inner surface of the impact absorbing liner, so as to be in contact with a user's head during use of the protective helmet;

wherein the comfort liner comprises at least one cheek pad which is coupled to the impact absorbing liner by means of at least one connecting element; and at least one recess provided in the impact absorbing liner and configured to house a corresponding one of said at least one connecting element;

said at least one connecting element is elastically deformable for moving between a first configuration wherein said at least one connecting element is either inserted or released from said at least one recess and a second configuration wherein said at least one connecting element is clamped inside said at least one recess; and the protective helmet further comprising a release device directly connected to said at least one connecting element, said release device when actuated being able to elastically deform said at least one connecting element to move said at least one connecting element from the second configuration into the first configuration, thereby allowing the release of said at least one cheek pad from the impact absorbing liner.

2. The protective helmet according to claim 1, characterized in that said at least one cheek pad includes a padding layer and a pad back plate, said at least one connecting element projecting from the pad back plate in a direction opposite to the padding layer.

3. The protective helmet according to claim 2, characterized in that the release device is positioned between the pad back plate and the padding layer.

4. The protective helmet according to claim 2, characterized in that the pad back plate is made of polymeric rigid material.

5. The protective helmet according to claim 2, characterized in that said at least one connecting element is a snap-fit device designed to be clamped inside said at least one recess provided in the impact absorbing liner.

6. The protective helmet according to claim 1, characterized in that said at least one connecting element is a snap-fit device designed to be clamped inside a recess provided in the impact absorbing liner.

7. The protective helmet according to claim 6, characterized in that said at least one connecting element comprises a main body having an outwardly projecting portion designed to enter and be caught in a corresponding depression provided in the recess.

8. The protective helmet according to claim 7, characterized in that said projecting portion is tapered towards a forward end of the projecting portion.

9. The protective helmet according to claim 7, characterized in that the release device is connected to said at least one connecting element in proximity to the projecting portion.

10. The protective helmet according to claim 6, characterized in that said at least one connecting element is a cantilever snap-fit device.

11. The protective helmet according to claim 10, characterized in that said at least one connecting element comprises a main body having an outwardly projecting portion designed to enter and be caught in a corresponding depression provided in said at least one recess, and characterized in that said at least one connecting element is a U-shaped cantilever snap-fit device, the main body comprising a first arm and a second arm connected to each other at a base portion, the projecting portion being provided on the second arm.

12. The protective helmet according to claim 11, characterized in that the first arm is rigidly connected to the base plate of the cheek pad, extending from the base plate towards the base portion of the at least one connecting element, the second arm extending from the base portion towards a groove provided in the base plate so that an end of the second arm is free to oscillate, when stressed, inside said groove.

13. The protective helmet according to claim 12, characterized in that the projecting portion is provided on the second arm in proximity to the base portion and the release device is connected to the at least one connecting element in proximity to said end of the second arm.

14. The protective helmet according to claim 1, characterized in that said at least one recess has a depth which corresponds to a projecting height of the at least one connecting element.

15. The protective helmet according to claim 1, characterized in that the release device comprises a strap having a first end connected to said at least one connecting element and a second end designed to be positioned at a lower portion of said at least one cheek pad.

16. The protective helmet according to claim 15, characterized in that the second end of the release device is provided with an actuating element.

17. The protective helmet according to claim 15, characterized in that said at least one connecting element comprises a plurality of connecting elements and said at least one cheek pad is provided with the plurality of connecting elements and in that the release device comprises a corresponding plurality of straps, each strap of said corresponding plurality of straps having a first end connected to a different connecting element of a corresponding one of said plurality of connecting elements and having a second end connected to another such said second end so as to be combined in a single strap provided with a single actuating element.

18. The protective helmet according to claim 15, characterized in that said at least one connecting element is a snap-fit device designed to be clamped inside said at least one recess provided in the impact absorbing liner, and characterized in that the pad back plate comprises guiding means suitable for engaging the release device, the guiding means having the function to guide a portion of the release device comprised between the first end and the second end.

19. The protective helmet according to claim 18, characterized in that the guiding means is configured to direct a pulling force applied to a tab of the release device to said at least one connecting element along a direction causing an elastic deformation of the connecting element, such elastic deformation causing the disengagement of the corresponding projecting portion from the depression.

20. The protective helmet according to claim 19, characterized in that said at least one connecting element comprises a main body having an outwardly projecting portion designed to enter and be caught in a corresponding depression provided in said at least one recess;

characterized in that said at least one connecting element is a U-shaped cantilever snap-fit device, the main body comprising a first arm and a second arm connected to each other at a base portion, the projecting portion being provided on the second arm, and characterized in that the tab, when under application of the pulling force, is configured to cause a bending of the second arm towards the first arm of the connecting element, the bending causing release of the projecting portion from the depression.

21. The protective helmet according to claim 18, characterized in that said guiding means are selected from the group consisting of arch elements or guiding pins.

22. The protective helmet according to claim 18, characterized in that said guiding means comprise one or more Bowden cables designed to house the release device, the Bowden cables being fastened to the pad back plate.

* * * * *